US007926149B2

(12) United States Patent
Weston

(10) Patent No.: US 7,926,149 B2
(45) Date of Patent: Apr. 19, 2011

(54) MOVEABLE TOWEL CLIP FOR GOLF BAG

(76) Inventor: Keith Weston, Billerica, MA (US)

( * ) Notice: Subject to any disclaimer, the term of this patent is extended or adjusted under 35 U.S.C. 154(b) by 773 days.

(21) Appl. No.: 11/906,401

(22) Filed: Oct. 2, 2007

(65) Prior Publication Data

US 2008/0087616 A1 Apr. 17, 2008

Related U.S. Application Data

(60) Provisional application No. 60/827,735, filed on Oct. 2, 2006.

(51) Int. Cl.
*A63B 57/00* (2006.01)
*A47F 5/00* (2006.01)

(52) U.S. Cl. ..... 24/3.12; 24/3.6; 248/229.16; 248/689; 248/231.81; 224/269; 224/666; 206/315.3; 206/315.5; 211/86.01; 211/16

(58) Field of Classification Search ..... 24/3.12, 24/457, 343, 318, 370, 372, 375, 3.11; 206/315.3, 206/315.2, 315.5; 150/159; 224/666, 268, 224/269, 932; 211/16, 6, 86.01, 106.01, 211/70.2, 85.31, 85.17; 248/689, 229.16, 248/229.26, 231.81, 316.1
See application file for complete search history.

(56) References Cited

U.S. PATENT DOCUMENTS 747,119 A * 12/1903 Barry ..... 24/13
845,743 A * 3/1907 Bindner ..... 24/3.6
867,255 A * 10/1907 Dietz ..... 24/3.6
1,304,403 A * 5/1919 Storch et al. ..... 24/3.6
4,113,156 A * 9/1978 Brito ..... 224/666
5,161,683 A 11/1992 Smith
5,372,414 A 12/1994 Lamonakis et al.
5,450,954 A 9/1995 Dunn
5,586,674 A * 12/1996 Nachbauer ..... 206/315.4
5,860,191 A * 1/1999 Sieger ..... 24/3.3
6,273,279 B1 8/2001 Wolf
6,484,365 B1 * 11/2002 Thompson ..... 24/3.12
2002/0010983 A1 * 1/2002 Lee ..... 24/3.12
2004/0004169 A1 * 1/2004 Hays ..... 248/229.16
2004/0159756 A1 * 8/2004 Albertson ..... 248/227.1
2005/0045685 A1 * 3/2005 Sesto ..... 224/587
2007/0051768 A1 * 3/2007 Dobson et al. ..... 224/666

* cited by examiner

*Primary Examiner* — Daniel P Stodola
*Assistant Examiner* — Rowland D Do
(74) *Attorney, Agent, or Firm* — James Ray & Assoc

(57) ABSTRACT

A moveable clip device for hanging a towel on a golf bag that includes an S-shaped clip member having a first strip portion engageable with an inner surface of an open end of the golf bag, a second strip portion engageable with an outer surface of the open end of such golf bag, and a third strip portion. A first connecting strip portion, engageable with an edge of the open end of such golf bag, connects the first and second strip portions. A second connecting strip portion connects the second and third strip portions. A flange portion having a channel formed between first and second wall portions is connected to the third strip portion. A support member is connected to each of the wall portions for supporting the towel on the clip. A mechanism is engageable with the towel and support member for connecting such towel to the clip.

15 Claims, 1 Drawing Sheet

MOVEABLE TOWEL CLIP FOR GOLF BAG

CROSS REFERENCE TO RELATED APPLICATION

This application is closely related to and claims priority from U.S. Provisional Patent Application Ser. No. 60/827,735 filed on Oct. 2, 2006.

FIELD OF THE INVENTION

The present invention relates, in general, to devices used for holding or hanging various golf accessory items on golf bags and, more particularly, the invention relates to a moveable clip device capable of hanging a towel in different locations on a golf bag.

BACKGROUND OF THE INVENTION

Clip devices for holding or hanging golf accessory items on a golf bag that are used during a round of golf, such as tees, ball markers, ball mark repair tools, umbrellas and towels have been in existence many years prior to the conception and development of the present invention, as is generally well known in the prior art. Conventional golf towel clips are usually made from a thin wire that bends easily and, due to its construction, can only be attached to certain parts of the golf bag.

SUMMARY OF THE INVENTION

The present invention provides a moveable clip device for hanging a towel on a golf bag. The device includes an elongated substantially S-shaped clip member made from a first predetermined material. The clip member includes an elongated first strip portion having first and second ends. The first strip portion is engageable with an inner surface portion of an open end of the golf bag. The clip member also includes an elongated second strip portion having first and second ends. The second strip portion is engageable with an outer surface portion of the open end of such golf bag. The clip member further includes an elongated third strip portion having first and second ends. A first connecting strip portion of the clip member is engageable with an edge portion of such open end of the golf bag. The first connecting strip portion has a first end thereof connected to the second end of such first strip portion and a second end thereof connected to the second end of such second strip portion. A second connecting strip portion of the clip member has a first end connected to the first end of such second strip portion and a second end connected to the first end of such third strip portion. A flange portion of the clip member is connected to the second end of such third strip portion. The flange portion has a channel formed therein between first and second wall portions thereof. The moveable clip device also includes a support means made from a second predetermined material. The support means is connected to each of the first and second wall portions for supporting the towel on such clip member. The moveable clip device further includes a connection means engageable with the towel and such support means for connecting such towel to the clip member and thus hanging the towel on the golf bag when such clip member is engaged with the golf bag.

OBJECTS OF THE INVENTION

It is, therefore, one of the primary objects of the present invention to provide a moveable clip device that can hang in different locations on a golf bag.

Another object of the present invention is to provide a moveable clip device for hanging a golf towel on a golf bag that is constructed from a flexible and durable material.

Yet another object of the present invention is to provide a moveable clip device for hanging a golf towel on a golf bag that is relatively easy to manufacture.

A further object of the present invention is to provide a moveable clip device for hanging a golf towel on a golf bag that is relatively inexpensive to make.

In addition to the various objects and advantages of the present invention described with some degree of specificity above it should be understood that additional objects and advantages of the present invention will become more readily apparent to those persons who are skilled in the relevant art from the following more detailed description of the invention, particularly, when such description is taken in conjunction with the attached drawing figure and with the appended claims.

Figure 2:
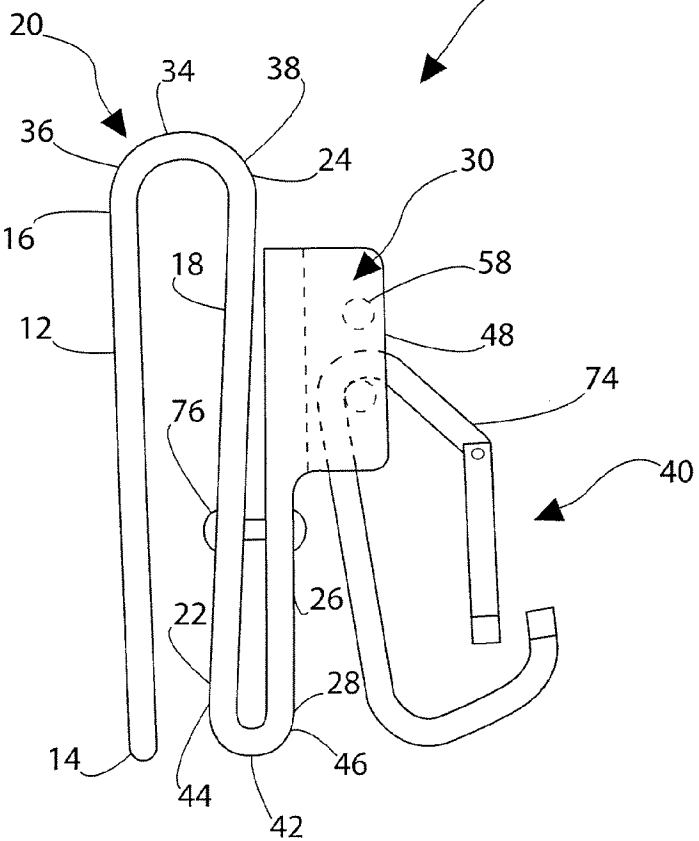
FIG. 2 is a side view of the moveable clip device for hanging a towel on a golf bag according to another embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 1:
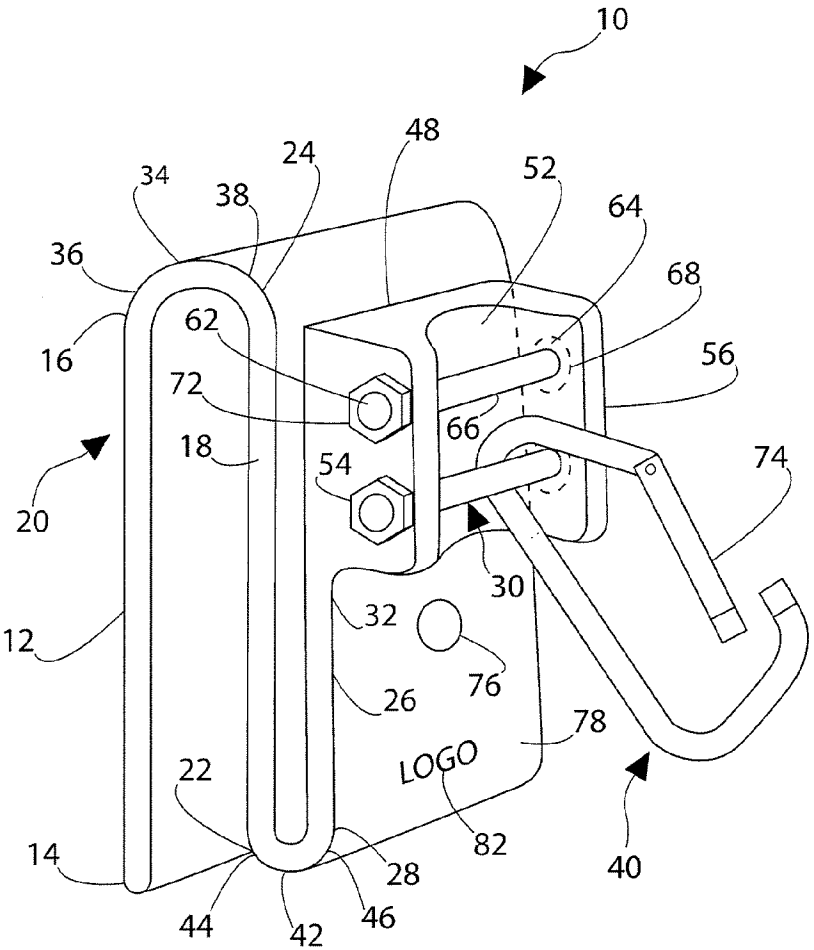
FIG. 1 is a perspective view of the moveable clip device for hanging a towel on a golf bag according an embodiment of the present invention.

Reference is now made, more particularly, to drawing FIGS. 1 and 2, illustrated therein is a moveable clip device, generally designated 10, for hanging a towel (not shown) on a golf bag (not shown). Device 10 includes an elongated substantially S-shaped clip member, generally designated 20, made from a first predetermined material. Clip member 20 includes an elongated first strip portion 12 having first end 14 and second end 16. First strip portion 12 is engageable with an inner surface portion of an open end of the golf bag. Clip member 20 also has an elongated second strip portion 18 having first end 22 and second end 24. Second strip portion 18 is engageable with an outer surface portion of the open end of such golf bag. Clip member 20 further includes an elongated third strip portion 26 having first end 28 and second end 32.

A first connecting strip portion 34 of clip member 20 has a first end 36 connected to the second end 16 of first strip portion 12 and a second end 38 connected to the second end 24 of second strip portion 18. First connecting strip portion 34 is engageable with an edge portion of such open end of the golf bag. A second connecting strip portion 42 of clip member 20 has a first end 44 connected to first end 22 of said second strip portion 18 and a second end 46 connected to first end 28 of third strip portion 26. A flange portion 48 of clip member 20 is connected to second end 32 of third strip portion 26. Flange portion 48 has a channel 52 formed therein. Channel 52 has a first wall portion 54 and a second wall portion 56 on either side thereof.

Device 10 also includes a support means, generally designated 30, made from a second predetermined material. Support means 30 is connected to each of first wall portion 54 and second wall portion 56 for supporting the towel on clip member 20.

Device 10 further includes a connection means, generally designated 40, made from a third predetermined material. Connection means 40 is engageable with the towel and support means 30 for connecting such towel to clip member 20 thus hanging the towel on such golf bag when clip member 20 is engaged with the golf bag.

Preferably, each of the first, second and third predetermined materials will be selected from the group consisting of plastic, metal and a combination thereof. In one embodiment, the first and second predetermined materials will be identical with the predetermined material being one of plastic and metal.

At least one of first connecting strip portion 34 and second connecting strip portion 42 may have an arcuate shape. In a presently preferred embodiment, however, each of them will have an arcuate shape. It is also presently preferred that first connecting strip portion 34 be wider than second connecting strip portion 42 for ensuring that clip member 20 slips over the edge portion of such open end of the golf bag and secures tightly thereto.

Support means 30, preferably, includes at least one rod member 58. As shown in FIG. 2, at least one rod member 58 may be molded into flange portion 48. In another embodiment, each end of the at least one rod member 58 may be one of glued and welded to a respective one of first wall portion 54 and second wall portion 56.

In another embodiment shown in FIG. 1, each of wall portions 54 and 56, respectively, of flange portion 48 may include at least one aperture. Aperture 62 in first wall portion 54 being substantially axially aligned with aperture 64 in second wall portion 56. Also, in this embodiment, at least one rod member 58 will be a stainless steel bolt 66 having a head portion 68 thereof abutting against an outer surface of second wall portion 56 adjacent aperture 64 and a threaded portion of bolt 66 having a stainless steel nut 72 threaded thereon that abuts against an outer surface of first wall portion 54 adjacent aperture 62.

Connection means 40 may include at least one ring member, which connects around at least one rod member 58 and through an eyelet in the towel. Preferably, the at least one ring member will be a carabiner 74.

Device 10 may further include a flexible plug member 76 connected to each of second strip portion 18 and third strip portion 26 between first and second ends thereof for allowing third strip portion 26 to flex away from second strip portion 18 a predetermined distance and substantially preventing third strip portion 26 to be pulled away further than the predetermined distance putting strain on second connecting strip portion 42. Flexible plug member 76 is, preferably, made from one of synthetic rubber and natural rubber.

Also, a front surface portion 78 of third strip portion 26 may include predetermined indicia 82 thereon. The predetermined indicia on front surface portion 78 of third strip portion 26 could be one of a name and a logo of a particular organization.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A moveable clip device for hanging a towel on a golf bag, said device comprising:

(a) an elongated substantially S-shaped clip member made from a first predetermined material and including, (i) an elongated first strip portion engageable with an inner surface portion of an open end of such golf bag and having first and second ends, (ii) an elongated second strip portion engageable with an outer surface portion of such open end of such golf bag and having first and second ends, (iii) an elongated third strip portion having first and second ends, (iv) a first connecting strip portion engageable with an edge portion of such open end of such golf bag and having a first end connected to said second end of said first strip portion and a second end connected to said second end of said second strip portion, (v) a second connecting strip portion having a first end connected to said first end of said second strip portion and a second end connected to said first end of said third strip portion, and (vi) a flange portion connected to said second end of said third strip portion and having a channel formed therein, said channel forming first and second wall portions;

(b) a support means made from a second predetermined material and connected to each of said first and second wall portions for supporting such towel on said clip member wherein said support means comprises at least one rod member; and (c) a connection means made from a third predetermined material and engageable with such towel and said support means for connecting such towel to said clip member and thus hanging such towel on such golf bag when said clip member is engaged with such golf bag wherein said connection means includes at least one ring member which connects around said at least one rod member and is engageable with an eyelet in such towel.

2. A device, according to claim 1, wherein said first, second and third predetermined materials are selected from the group consisting of plastic, metal and a combination thereof.

3. A device, according to claim 1, wherein said first and second predetermined materials are identical.

4. A device, according to claim 3, wherein said first and second predetermined materials are one of plastic and metal.

5. A device, according to claim 1, wherein said first connecting strip portion is wider than said second connecting strip portion for ensuring that said clip member slips over such edge portion of such open end of such golf bag and secures tightly thereto.

6. A device, according to claim 1, wherein at least one of said first and second connecting strip portions has an arcuate shape.

7. A device, according to claim 6, wherein each of said first and second connecting strip portions has an arcuate shape.

8. A device, according to claim 7, wherein said first connecting strip portion is wider than said second connecting strip portion for ensuring that said clip member slips over such edge portion of such open end of such golf bag and secures tightly thereto.

9. A device, according to claim 1, wherein each of said first and second wall portions of said flange portion includes at least one aperture, said aperture in said first wall portion substantially axially aligned with said aperture in said second wall portion.

10. A device, according to claim 9, wherein said at least one rod member is a stainless steel bolt having a head portion thereof abutting against an outer surface of one of said wall portions adjacent said aperture thereof and a threaded portion of said bolt having a stainless steel nut threaded thereon that abuts against an outer surface of other one of said wall portions adjacent said aperture thereof.

11. A device, according to claim 1, wherein said at least one ring member is a carabiner.

12. A device, according to claim 1, wherein a front surface portion of said third strip portion includes predetermined indicia thereon.

13. A device, according to claim 12, wherein said predetermined indicia on said front surface portion of said third strip portion is one of a name and a logo of a particular organization.

14. A moveable clip device for hanging a towel on a golf bag, said device comprising:

(a) an elongated substantially S-shaped clip member made from a first predetermined material and including, (i) an elongated first strip portion engageable with an inner surface portion of an open end of such golf bag and having first and second ends, (ii) an elongated second strip portion engageable with an outer surface portion of such open end of such golf bag and having first and second ends, (iii) an elongated third strip portion having first and second ends, (iv) a first connecting strip portion engageable with an edge portion of such open end of such golf bag and having a first end connected to said second end of said first strip portion and a second end connected to said second end of said second strip portion, (v) a second connecting strip portion having a first end connected to said first end of said second strip portion and a second end connected to said first end of said third strip portion, and (vi) a flange portion connected to said second end of said third strip portion and having a channel formed therein, said channel forming first and second wall portions;

(b) a support means made from a second predetermined material and connected to each of said first and second wall portions for supporting such towel on said clip member; and (c) a connection means made from a third predetermined material and engageable with such towel and said support means for connecting such towel to said clip member and thus hanging such towel on such golf bag when said clip member is engaged with such golf bag, wherein said device further includes a flexible plug member connected to each of said second and third strip portions between first and second ends thereof for allowing said third strip portion to flex away from said second strip portion a predetermined distance and substantially preventing said third strip portion to be pulled away further than said predetermined distance putting strain on said second connecting strip portion.

15. A device, according to claim 14, wherein said flexible plug member is made from one of synthetic rubber and natural rubber.

* * * * *